US005435647A

United States Patent [19]

Oliver

[11] Patent Number: 5,435,647

[45] Date of Patent: Jul. 25, 1995

[54] GAS-FILLED HANDLE FOR FLEXIBLE BAG

[76] Inventor: David A. Oliver, 816 Haverford Ave., Unit 6, Pacific Palisades, Calif. 90272

[21] Appl. No.: 276,695

[22] Filed: Jul. 18, 1994

[51] Int. Cl.[6] ..... B65D 33/10

[52] U.S. Cl. ..... 383/3; 383/8; 383/17

[58] Field of Search ..... 383/3, 35, 17, 20, 104

[56] References Cited

U.S. PATENT DOCUMENTS 3,506,048 4/1970 Jortikka .
3,550,839 12/1970 Clayton et al. ..... 383/35 X
3,567,110 3/1971 Susuki et al. .
4,384,602 5/1983 Ores ..... 383/8 X
4,854,732 12/1986 Italici .
4,981,216 1/1991 Wilfong, Jr. ..... 383/8 X

*Primary Examiner*—Allan N. Shoap
*Assistant Examiner*—Jes F. Pascua

[57] ABSTRACT

Flexible bag handle(s) that is constructed of a non-porous, flexible membrane filled with a gaseous substance. The membrane encapsulates the gaseous substance to form a gas-filled pocket(s) that comprises a bag handle(s). The gas-filled pocket(s) that comprises the Gas-Filled Handle(s), can be of various size(s), shape(s) and arrangement(s) depending upon the desired load-bearing characteristics and desired length of the handle(s).

1 Claim, 1 Drawing Sheet

GAS-FILLED HANDLE FOR FLEXIBLE BAG

BACKGROUND

1. Field of Invention

This invention relates to a handle(s) that is attached to or are a part of a flexible bag.

2. Description of Prior Art

Grocery stores and various other retail establishments commonly supply consumers with a flexible bag to hold and carry produce and other purchases. The handles for these flexible bags that have handles are normally a simple loop consisting of the same material from which the bag itself is constructed.

The design of this loop handle provides adequate strength to support the contents of the bag, but it does not ensure adequate distribution of the weight of the bag's contents over the surface area of the user's fingers or other appendage used to support the bag's handle(s). As the weight of the contents of the bag increases, the loop handle tends to collapse to a very narrow band that represents essentially the actual material of the handle, but which is no longer in an uncollapsed or distributed state.

Previous devices have been developed to address bag handles with the intent of making these bags more comfortable and allowing the user thereby to carry more weight. However, these devices have had various shortcomings including added manufacturing cost which is a primary consideration. In these alternatives added components or materials are required to broaden the area of the handle over which the weight of the contents are distributed. These alternatives include:

U.S. Pat. No. 3,506,048, 16 Feb. 1968, to Jortikka of Finland describes handles made of plastic ribbon which is welded to the bag's plastic foil. The invention requires that the handles be formed from thin plastic tubing which, while still hot, is pressed flat so that the walls of the tubing adhere to each other. None of the benefits of added weight distribution and comfort are available if the walls of the tubing are welded flat.

U.S. Pat. No. 3,567,110, 3 Jun. 1968, to Susuki, Hoshi, Araki, Ohshita and Miyamoto of Japan where a thick piece of plate made of synthetic resin is bonded to the bag material. This provides a similar, but reduced carrying capacity since the plate molded into the handle would be inflexible and would not mold to the user's hand or other appendage. The plate design also adds manufacturing costs for the material as well as logistics costs related to the extra weight that the plate adds.

U.S. Pat. No. 4,854,732, 5 Dec. 1986, to Italici of Italy describes bag handles which contain "floatation elements" to make the bag unsinkable. This design requires added manufacturing costs and added weight related to the floatation elements. Since this design requires the use of a waterproof fabric, but not a fabric that is impermeable to a gas, it would not be possible to maintain a simple gas pocket within this handle.

OBJECTS AND ADVANTAGES

Accordingly, several objects and advantages of my invention are that no additional materials are required for the recurring manufacture of a bag which possesses a Gas-Filled Handle. Also, the Gas-Filled Handle accomplishes or improves upon the goal of other handle designs which seek to disburse the weight being supported over a broader area. This requirement is met with the Gas-Filled Handle while simultaneously providing a softer "cushion" to absorb changes in weight displacement. A Gas-Filled Handle will tend to mold itself to conform to the shape of the hand or whatever is used to support the bag. This reduces pressure spots where the weight of the contents of the bag is unevenly positioned on the appendage supporting the bag's handle.

The design of a Gas-Filled Handle would not add appreciably to the weight of an existing bag with handle design. Conversely, if the weight of the gas used to fill the handle is less that the weight of air, the net weight of the gas used to fill the handle would actually be less than a bag without the handle filled with that gas.

One form of a Gas-Filled Handle would include segmented gas-filled pockets that are formed by providing additional seals that reduce the size of the pocket while increasing the number of pockets. Some of the advantages realized by reducing the size of the pocket and increasing the number are:

- added strength attained by reducing the volume of the gas which can be concentrated at any seam or surface area of the pocket,
- additional segmentation minimizes the loss of benefits in the event that one of the pockets ruptures, and
- increasing the number of pockets reduces the extent that the gas may shift within the pocket if weight is more heavily concentrated on one part of the pocket.

By adding to the volume of the handle by filling it with a gas, the handle itself becomes more distinct thereby allowing for easier use when separating the handles to open the bag.

Adding gas to fill the handles also permits the user additional options when stowing the bag with its contents since the Gas-Filled Handles could be folded into the bag and used as additional packing material to protect delicate items.

Enlarging the size of the handle by filling it with a gas also provides a more sure grip for the user of the bag.

Further objects and advantages of my invention will become apparent from a consideration of the drawings and ensuing description.

DRAWING FIGURES

Figure 1:
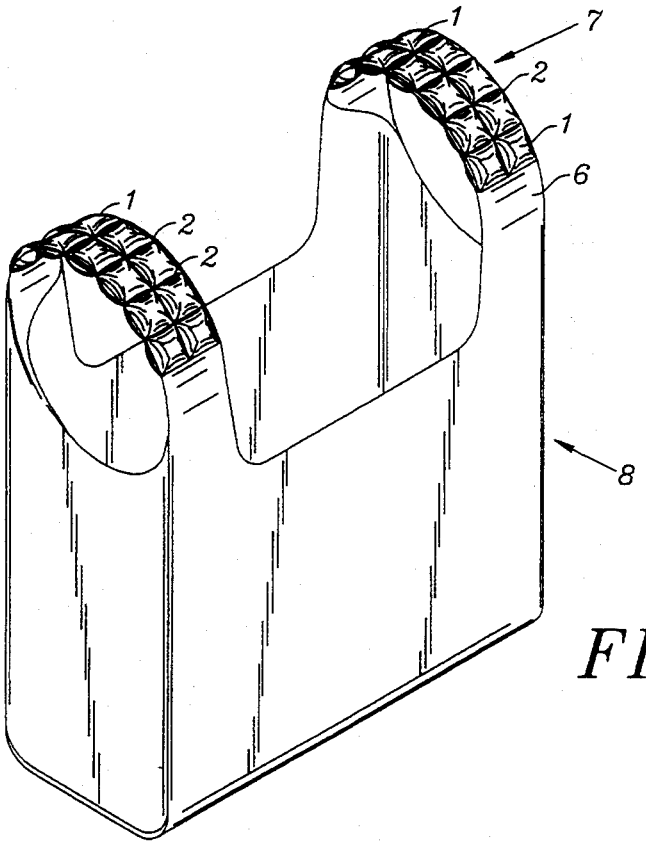
FIG. 1 shows the various aspects of one possible configuration of a Gas-Filled Handle portrayed at an indirect angle which includes a view of an example flexible bag with shading of the portions filled with a gas to show perspective.
Figure 3:
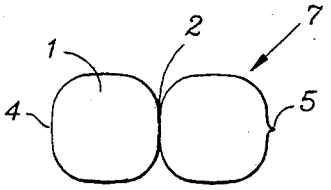
FIG. 3 shows an end, cross section view of a Gas-Filled Handle showing one possible configuration of multiple, sealed pockets of gas.

| Reference Numerals In Drawings | |
|---|---|
| 1 Gas-filled Pocket | 5 External Seam |
| 2 Separation Seam | 6 Adjoining Length of Handle |
| 3 Handle Truncation for Drawing | 7 Gas-Filled Handle |
| 4 Seamless Side of Handle | 8 Flexible Bag |

DESCRIPTION—FIGS. 1-3

Figure 2:
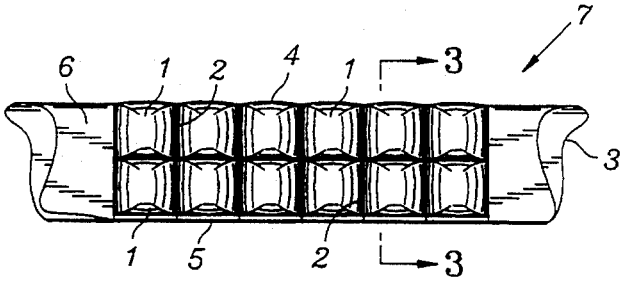
FIG. 2 shows a longitudinal view of one possible configuration of a Gas-Filled Handle with no perspective angle and which is trucated at the handle to exclude the flexible bag. This figure also identifies the cross-section of the Gas-Filled Handle which is illustrated in FIG. 3.

A typical embodiment of the Gas-Filled Handle including a flexible bag is illustrated in FIG. 1 (indirect, perspective view) and FIG. 2 (longitudinal view, handle only). The invention has one or more seams 2,5 which retain a gas that is contained within the pocket(s) 1. The pocket(s) is formed by sealing a plastic vellum or any other material that is flexible and non-porous that will retain a gaseous substance including polyethylene, polypropylene, vinyl, nylon, rubber, various plasticized materials, etc. which comprises a flexible bag 8 and handle 7 or the handle only. This seam(s) is formed by joining, or sealing, two or more layers of the non-porous handle material by conventional means in a manner which is likely identical to that used to form the seams of the accompanying bag. Any gas which is present or introduced during the manufacturing process becomes enclosed in the pocket formed between two layers of non-porous material that is sealed to form the outer seam of the gas-filled pocket. The gas-filled pocket(s) which comprises the Gas-Filled Handle can be of various sizes, shapes and arrangements depending upon the desired load-bearing characteristics and desired length of the handle.

Both ends of the Gas-Filled Handle are truncated 3 in FIG. 2 beyond the gas-filled portion of the handle and this represents the location where the gas-filled portion of the handle ends and the flexible bag to which the handle is attached or an adjoining length of handle material starts 6.

A typical method of forming the gas-filled pocket(s) would be to fold a non-porous material so that a seam would not be required on one side of the gas-filled pocket(s) 4. This side of the pocket includes the portion of the handle which contains a fold in the handle's material. This would also permit a more comfortable grip on the one side of the gas-filled pocket(s) that does not contain a seam. Alternatively, the handle material could be extruded and filled with a gas and sealed as it is extruded which would eliminate any seams on the handle.

From the description above, a number of advantages of the Gas-Filled Handle become evident:

(a) The manufacturing process can be easily automated thereby minimizing the cost of this improvement.

(b) The cost increase for the material to provide a Gas-Filled Handle can be zero since the design can be accommodated with existing material as commonly found with existing flexible bag designs for non-porous material. Also, if air were to be used as the filler material, material cost would remain essentially unchanged except for possible processing costs.

(c) If existing materials are used for manufacture of a Gas-Filled Handle, minimal, zero or negative increase in weight would result from this Gas-Filled Handle design depending upon the weight of the gas used to fill the pocket(s) which comprise(s) the handle relative to the weight of air.

(d) If more than one gas-filled pocket is employed to constitute the Gas-Filled Handle, a rupture of a pocket so that it would leak its gas contents and deflate would not entirely eliminate the usefulness of the Gas-Filled Handle design. This is due to the fact that another pocket(s) which still retains its gas would act to continue to maintain much of the volume of the Gas-Filled Handle, thereby preserving the improved handle's load distribution capabilities.

(e) By varying the size and shape of the gas-filled pocket(s) which comprise the Gas-Filled Handle, the characteristics of the Gas-Filled Handle can be varied depending upon the carrying requirements for the bag to which the handle is attached.

OPERATION OF INVENTION

A Gas-Filled Handle is used similarly to any handle whereby an appendage supporting the handle, a human hand, for example, is placed on the underside of the Gas-Filled Handle, the closest side to the bag to which the handle is attached. The supporting appendage lifts the bag by the Gas-Filled Handle whereby the Gas-Filled Handle will become deflected relative to the shape of the supporting appendage and the weight of the bag and its contents. As a result of this deflection, the underside of the Gas-Filled Handle will tend to conform to the shape of the supporting appendage. Also, the gas-filled pocket(s) that forms the Gas-Filled Handle will tend to compress somewhat depending upon the level of inflation, gas composition and material forming the non-porous, flexible membrane forming the exterior of the pocket(s). This deflection adds to the load carrying capability of the Gas-Filled Handle by reducing pressure points at the interface between the Gas-Filled Handle and the supporting appendage. The presence of the gas will also cause the Gas-Filled Handle's non-porous exterior material to remain in an expanded and distributed state so that it does not tend to group together to form a single strand comprised of the mass of the handle material only.

If more than one gas-filled pocket is used to make up the whole of the handle, the amount of pressure which can be exerted on any point of the interior of the said pocket(s) by concentrating force upon one side of said pocket is minimized. This is due to the fact that the volume of gas which can be concentrated is decreased as the pocket is segmented into smaller cells. The size of the gas-filled pocket(s) is determined by the desired load bearing characteristics which are a function of the handle material, intended weight of the bag contents and the desired dispersion and deflection of the handle material. Greater load carrying capability can be realized by increasing the strength of the handle material and reducing the size of the gas-filled pocket(s) while increasing the quantity of the gas-filled pockets.

CONCLUSIONS, RAMIFICATIONS AND SCOPE OF INVENTION

Accordingly, one can understand that the Gas-Filled Handle invention will increase the utility of a flexible bag handle by increasing the load carrying capability of the bag user. This is accomplished with a very minimal increase in cost of the handle's manufacture and a minimal to negative increase in the handle's weight (negative if the gas filler is lighter than air). These benefits are realized while maintaining the handle material's normal durability for repeated use of the handle and associated bag.

The preceding description contains many specificities, but these should not be construed as limitations on the scope of the invention, but instead as a useful example of a likely configuration thereof. One can envision that many variations of the basic concept are possible and that the utility of the Gas-Filled Handle concept will have a broad variety of uses and applications. For example, the definitions of "flexible bag" and "Gas-Filled Handle" can readily be used to refer to a sling designed to carry an intended object which utilizes a Gas-Filled Handle for both flotation purposes as well as providing an easily identifiable and attachable handle which could be grasped for rescue work purposes. Filling the handle with a gas that is contained by the material of the handle as opposed to inserting a flotation element within a gas permeable fabric would likely make a simpler and less expensive flotation bag than previous designs.

Thus, the scope of the invention should be determined not by the specifications illustrated, but by the appended claims and their legal equivalents.

I claim:

1. A flexible, plastic bag comprising;

front, rear and side walls integrally connected to form a closed bag bottom and open bag top;

a pair of laterally spaced handles connecting the front and rear walls across the open bag top, each of said handles including a gripping portion for gripping by a hand of a person when carrying the bag; and at least two layers of plastic material joined together by a plurality of pockets filled with a gas, said pockets being located only in said gripping portions.

* * * * *